US005637076A

United States Patent [19]

Hazard et al.

[11] Patent Number: 5,637,076

[45] Date of Patent: Jun. 10, 1997

[54] APPARATUS AND METHOD FOR CONTINUOUS PASSIVE MOTION OF THE LUMBAR REGION

[75] Inventors: Rowland G. Hazard, Burlington; Steven Reinecke, Richmond, both of Vt.

[73] Assignee: Ergomedics, Inc., Winooski, Vt.

[21] Appl. No.: 255,086

[22] Filed: Jun. 7, 1994

Related U.S. Application Data

[63] Continuation-in-part of Ser. No. 199,784, Feb. 22, 1994, which is a continuation-in-part of Ser. No. 887,877, May 26, 1992, abandoned.

[51] Int. Cl.[6] ..... A61H 1/00

[52] U.S. Cl. ..... 601/5; 601/148; 297/284.6

[58] Field of Search ..... 601/5, 148–152; 297/284.5, 284.6, 230.11, 230.12

[56] References Cited

U.S. PATENT DOCUMENTS

| | | | |
|---|---|---|---|
| 2,193,882 | 3/1940 | Petersen . | |
| 2,240,679 | 5/1941 | Stauffer . | |
| 2,307,331 | 1/1943 | Parker, Jr. | 297/284.5 |
| 2,716,443 | 8/1955 | Laughlin | 297/230.11 |
| 2,756,808 | 7/1956 | Eichorst | 295/230.11 |
| 2,831,533 | 4/1958 | Pasquarelli | 297/284.5 |
| 3,596,654 | 8/1971 | Tamura . | |
| 3,974,827 | 8/1976 | Bodeen . | |
| 4,321,044 | 3/1982 | Kron | 434/59 |
| 4,516,568 | 5/1985 | Baxter et al. | 297/284.5 X |
| 4,574,786 | 3/1986 | Hashimoto et al. . | |
| 4,669,455 | 6/1987 | Bellati . | |
| 4,762,134 | 8/1988 | Gala . | |
| 4,833,614 | 5/1989 | Saitoh et al. | 297/284.6 X |
| 4,860,733 | 8/1989 | Parker, Jr. . | |
| 4,875,470 | 10/1989 | Cotone . | |
| 4,928,959 | 5/1990 | Bassett et al. . | |
| 4,981,131 | 1/1991 | Hazard . | |
| 5,022,385 | 6/1991 | Harza . | |
| 5,024,650 | 6/1991 | Hagiwara et al. . | |
| 5,033,457 | 7/1991 | Bonutti . | |
| 5,033,458 | 7/1991 | Sperr . | |
| 5,078,152 | 1/1992 | Bond et al. . | |
| 5,083,552 | 1/1992 | Lipowitz . | |
| 5,088,475 | 2/1992 | Steffensmeier . | |
| 5,099,702 | 3/1992 | French . | |
| 5,099,828 | 3/1992 | Duke . | |
| 5,103,808 | 4/1992 | Iams et al. . | |
| 5,165,390 | 11/1992 | Fleetwood . | |
| 5,255,188 | 10/1993 | Telepko | 601/5 X |
| 5,343,876 | 9/1994 | Rogers | 128/870 |

FOREIGN PATENT DOCUMENTS

| | | | |
|---|---|---|---|
| 128534 | 12/1984 | European Pat. Off. | 297/284.5 |
| 1256840 | 3/1965 | Germany . | |
| 2339069 | 8/1973 | Germany . | |
| 2441705 | 8/1974 | Germany . | |
| 462179 | 3/1937 | United Kingdom | 297/284.5 |
| WO83/00620 | 3/1983 | WIPO . | |
| 8300620 | 3/1983 | WIPO . | |
| WO91/06274 | 5/1991 | WIPO . | |

*Primary Examiner*—Robert A. Hafer
*Assistant Examiner*—Brian E. Hanlon
*Attorney, Agent, or Firm*—Choate, Hall & Stewart

[57] ABSTRACT

Apparatus for cycling the lower back of a person through a substantial range of lordosis. The apparatus includes a substantially static structure adjacent to the back of a person and a force applying apparatus disposed between the static structure and the back of the person. The force applying apparatus includes a back engaging surface cyclically movable to increase and decrease the distance between the static structure and the back engaging surface so as to cycle the lower back through the range of lordosis. A transducer has an output responsive to the force between the back engaging surface and the lower back and the output of the transducer is utilized by the force applying apparatus to control the force applied to the back. Timing circuitry provides a force increasing period to increase the force applied to the back up to a preselected maximum and a force decreasing period to decrease the force on the back. A period of substantially constant force may be provided between the force increasing period and the force decreasing period.

21 Claims, 12 Drawing Sheets

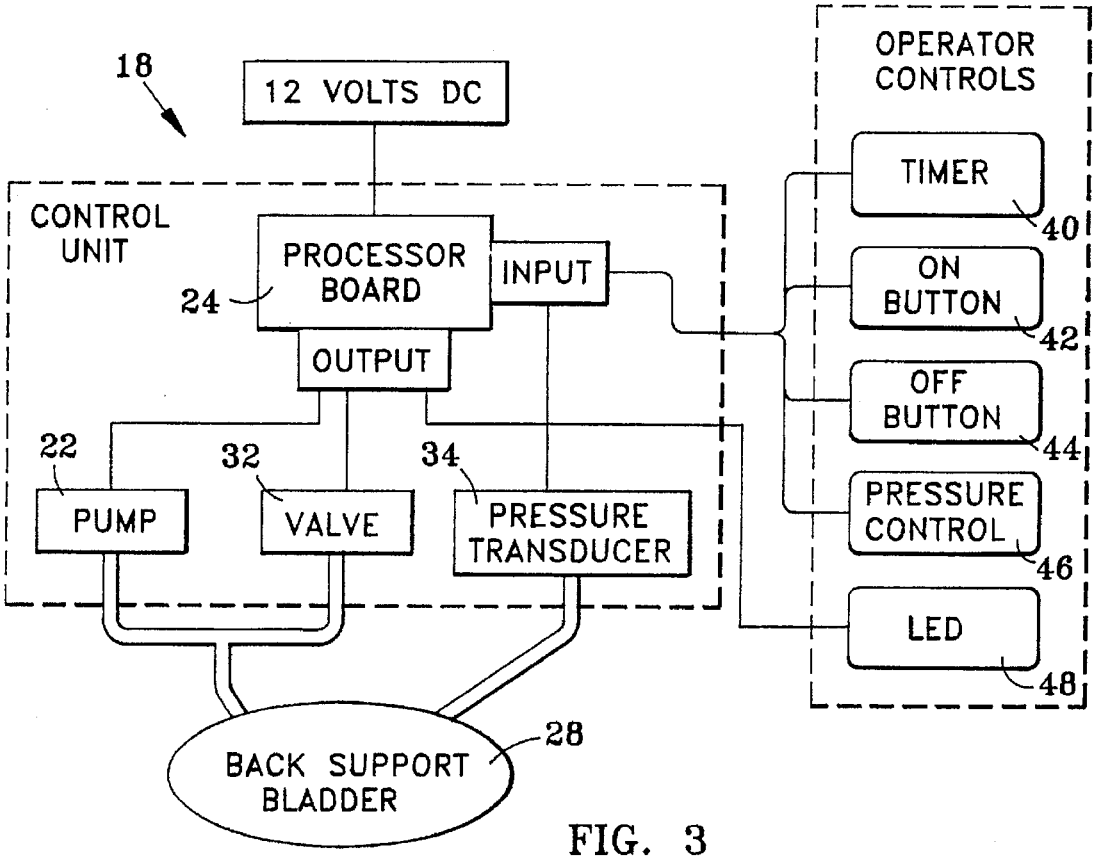
FIG. 3
FIG. 4
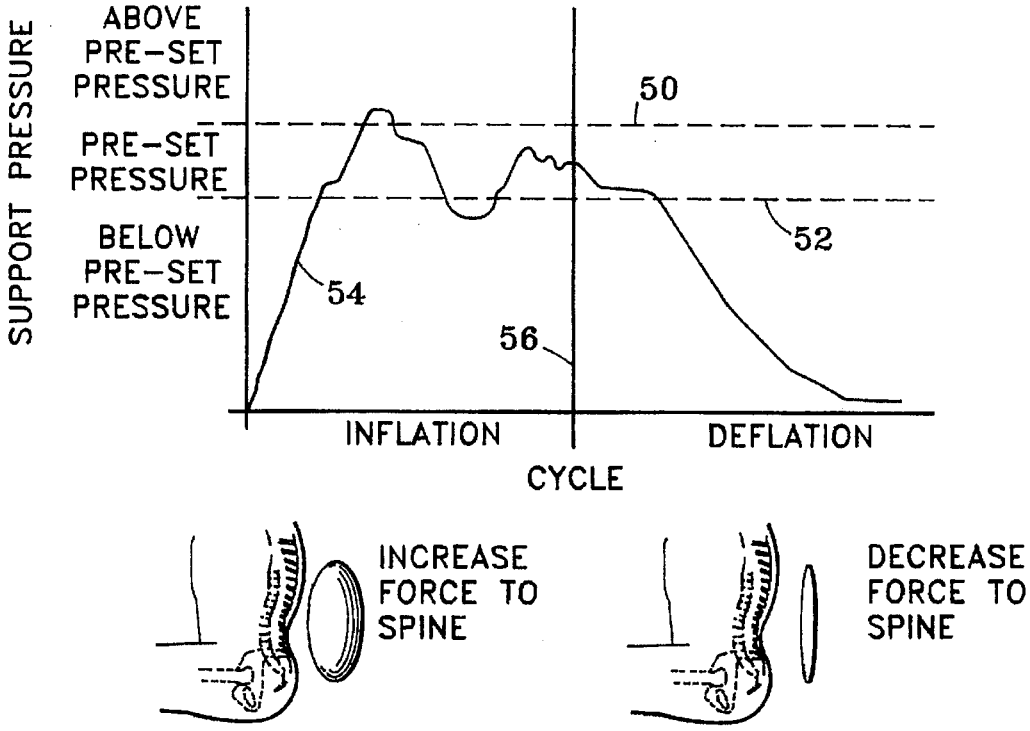

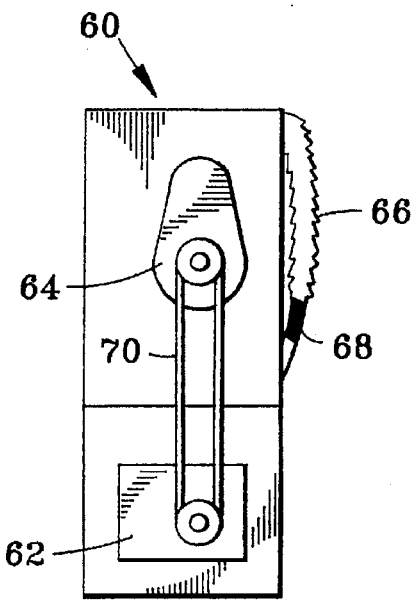
FIG. 8
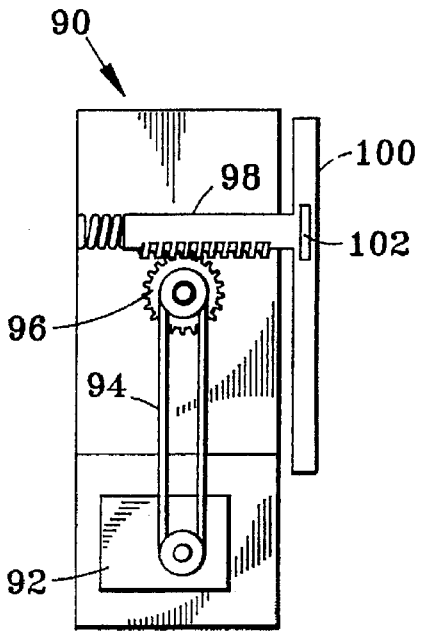
FIG. 9
FIG. 10
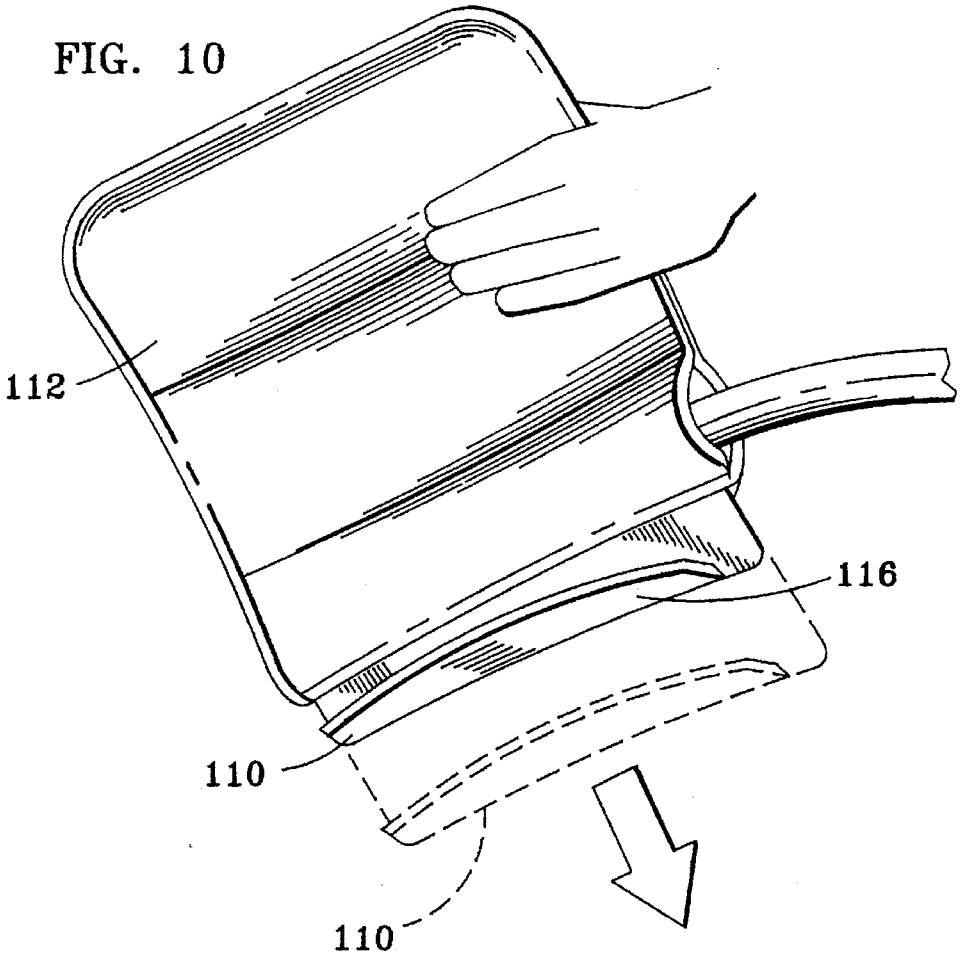

APPARATUS AND METHOD FOR CONTINUOUS PASSIVE MOTION OF THE LUMBAR REGION

This application is a continuation-in-part of application Ser. No. 08/199,784 filed Feb. 22, 1994 which is a continuation-in-part of Ser. No. 07/887,877 filed on May 26, 1992, now abandoned.

BACKGROUND OF THE INVENTION

This invention relates to method and apparatus for providing continuous passive motion to the body and more particularly to the lumbar region of the spine.

U.S. Pat. No. 4,981,131 issued to one of the inventors herein disclosed apparatus for cycling the lumbar region of the spine through a substantial range of lordosis for the purpose of relieving low back pain. The teachings of this patent are incorporated by reference herein. In this patent, an inflatable bladder in contact with the back is pressurized and depressurized to effect the substantial change in lordosis. There was no provision, however, to measure and control the force applied to the person's back throughout the inflate and deflate cycles. Therefore, the teachings in this patent could not readily accommodate variations in a person's spinal compliance, posture and position during the spinal mobilization. Nor did this patent teach adjustment of the location of the bladder to accommodate different individuals.

SUMMARY OF THE INVENTION

The apparatus for cycling the lower back of a person through a substantial range of lordosis includes a substantially static structure adjacent to the back of a person and a force applying apparatus disposed between the static structure and the back. The force applying apparatus includes a back engaging surface cyclically movable to increase and decrease the distance between the static structure and the back engaging surface, thereby to cycle the lower back through the range of lordosis. A transducer is provided having an output responsive to the force between the back engaging surface and the lower back. The force applying apparatus is responsive to the output of the transducer to control the force applied to the back. In a preferred embodiment, the apparatus further includes programmable circuitry for controlling the force to be a preselected function of time. In this embodiment, the apparatus includes timing circuitry to provide a force increasing period to increase the force applied to the back to a preselected maximum and a force decreasing period to decrease the force on the back. A third, substantially constant force period may be provided between the force increasing period and the force decreasing period.

In one embodiment, the force applying apparatus includes an inflatable and deflatable bladder and the transducer responds to pressure within the bladder. A pump supplies a fluid for inflating the bladder and a valve communicating with the bladder is provided for deflating the bladder. It is preferred that the location of the back engaging surface be adjustable in height so that the force engaging surface may be adapted to the lumbar region of a particular person.

In yet other embodiments, the force applying apparatus includes a rack and pinion or a mechanical cam arrangement for cyclically increasing and decreasing the force on the person's back. In these mechanical embodiments, the force transducer is a load cell. The force feedback of the present invention allows a maximum force to be preselected by the user to accommodate for that particular user's spine compliance and other factors.

BRIEF DESCRIPTION OF THE DRAWING

FIG. 3 is a schematic illustration of the functional relationship among components of the apparatus of the invention.

FIG. 4 is a graph of support pressure as a function of time.

FIG. 8 is a cross sectional view of a cam operated embodiment of the invention.

FIG. 9 is a cross sectional view of a rack and pinion embodiment of the present invention.

FIGS. 10, 11 and 12 are perspective views of an embodiment of the invention permitting adjustment of the location of the inflatable bladder.

DESCRIPTION OF THE PREFERRED EMBODIMENT

Figure 1:
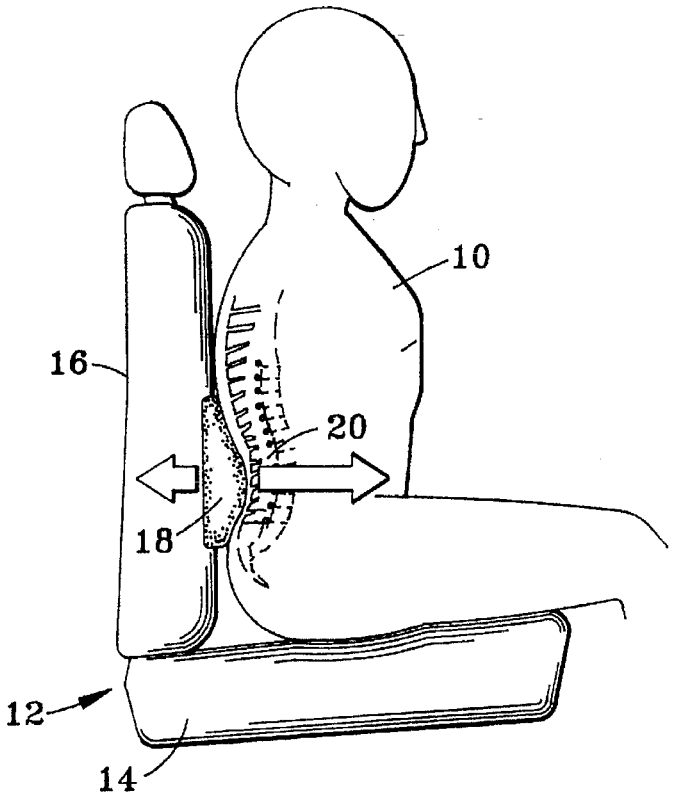
FIG. 1 is a cross-sectional view of an embodiment of the apparatus disclosed herein.

With reference first to FIG. 1 a person 10 is seated in a seat 12 having a bottom support 14 and a backrest portion 16. The seat 12 may typically be an automobile or other vehicle (airplane, boat) seat, or, for example, an office chair. Disposed between the person 10 and the backrest 16 in this embodiment is a continuous passive motion device 18. As will become clear below, the device 18 includes apparatus for cyclically moving the lumbar region 20 of the person 10 so as to cycle the lower back or lumbar region 20 through a substantial range of lordosis.

As discussed in detail in applicant's prior U.S. Pat. No. 4,981,131, research indicates that continuous passive motion of the lower back through a substantial range of lordotic movement ameliorates lower back pain. Such motion is not massage which relates merely to superficial tissues but constitutes motion of vertebrae with respect to one another. Because spinal compliance varies among individuals of a population, a force suitable for one individual may be insufficient or excessive for another person. The present invention recognizes these differences and provides preselected force versus time patterns to accommodate such variations in the general population.

Figure 2:
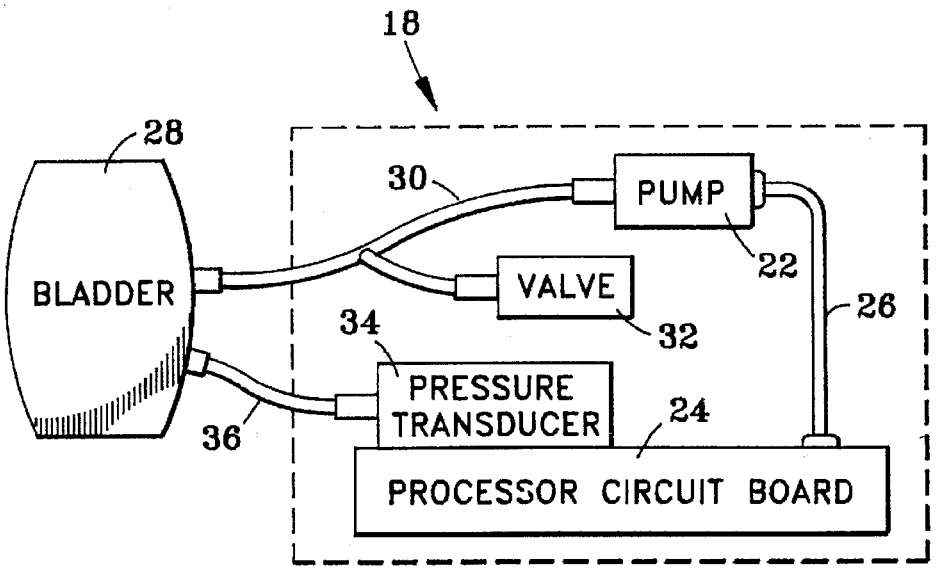
FIG. 2 is a schematic illustration of layout of the components for the apparatus of the invention.

FIG. 2 is a schematic representation of the layout used in a commercial version embodying the present invention and available from Ergomedics, Inc. of Winooski, Vt., assignee of the present application. In this embodiment, a pump 22, available from Appollo Enterprises, Inc., Ontario, Calif., model 5000, is preferably a 12 volt alternating current (AC) pump similar to those used for aerating fish tanks. It is preferred that the pump 22 be AC because AC pumps are less expensive than their direct current counterparts. A control or processor circuit board 24 synthesizes appropriate AC power which is supplied to the pump 22 through conductors 26. The processor board 24 operates on 12 volts DC supplied, for example, through the cigarette lighter in an automobile. The processor 24 converts the 12 volts DC to a four phase AC square wave for pump 22 operation.

The four phase square wave switches from plus 12 volts for 6.92 msec. to 0 volts for 1.54 msec. to minus 12 volts for 6.66 msec., to 0 volts for 1.54 msec., back to plus 12 volts, etc. By this process is created a substantially 60 Hz wave form. Suitable pumps may be in the 10–150 Hz range. It is preferred that the flow rate be in the 4–6 liters per minute flow rate range with a minimum pressure of 150 millimeters of mercury. The pump 22 supplies air to a bladder 28 through a flexible tube 30. A valve 32 communicates with the tube 30 and when open allows air to flow out of the bladder 28. A suitable valve 32 is available under the designation part number B6673 from Bicron Electronics Company of Canaan, Conn. This valve is normally opened and closed when a voltage is applied. It includes a return spring for positive opening.

The apparatus 18 includes a pressure transducer 34 which is in fluid communication with the bladder 28 through tubing 36. A preferred pressure transducer 34 is a silicon wafer providing a control voltage proportional to the pressure in the bladder 28. A suitable pressure transducer is available from Fujikura Ltd., Japan, type FPN-07PG.

With reference now to FIG. 3, the apparatus 18 includes operator controls such as a timer 40, ON and OFF buttons 42 and 44 and a pressure control 46. A light emitting diode (LED) 48 may be provided to indicate when the unit is operating.

An important aspect of this invention is the ability to control the force applied to the lumbar region to take into account variations in a user's spinal compliance and other factors such as variations in seating position. According to this embodiment of the invention, upon turning on the unit, the pump 22 begins supplying air to the bladder 28 causing the pressure in the bladder 28 to rise. This pressure is continuously monitored by the pressure transducer 34. Because the pressure transducer 34 communicates with the bladder 28 through a line separate from that utilized by the pump 22, the pressure transducer 34 is isolated from the low level pressure fluctuations generated by the operation of the pump 22. The operator adjusts the desired pressure setting using the pressure control 46. The preselected pressure set by the user will be maintained within plus or minus 4 millimeters of mercury with respect to the nominal set point. This pressure hysteresis is illustrated in FIG. 4. Lines 50 and 52 bound the nominal preselected pressure which is adjustable to be in the range from 10 millimeters mercury to 140 millimeters of mercury. In order to assure appropriate performance, the pressure transducer 34 should have a sensitivity to pressure changes within the bladder 28 of 2 millimeters of mercury.

As shown in FIG. 4 the system cycles between two states, namely, an inflation period and a deflation period. A typical inflation profile is represented by the curve 54. During this segment, pressure and hence force on the back increases to fall generally within the band defined by the lines 50 and 52. There may be some small amount of overshoot and undershoot depending on, for example, motion of the user. The time for inflation which is to the left of a line 56 and that for deflation which is to the right of the line 56 may be adjusted by the user using the timer control 40. A typical profile is 60 seconds of inflation followed by 60 seconds of deflation.

During the time-controlled inflation phase to the left of the line 56 in FIG. 4, the pump 22 fills the bladder to a pressure within the band around the preselected set point. The system will adjust the volume of air in the bladder in order to maintain a constant pressure in the bladder even if the user moves forward or backward in the seat. At the beginning of the cycle the pump 22 turns on to start filling the bladder 28 so as to increase the force to the back to provide the substantial change in the extent of lordosis. If, for example, the user were to move backward against the bladder during this filling phase thereby increasing pressure above the pre-set pressure level, the valve 32 is opened to reduce the pressure until the pressure is within the preselected band. Similarly, if the user moves forward, away from the bladder 28, thereby reducing the pressure in the bladder below the pre-set pressure level, the pump 22 is activated to increase the pressure until the pressure is again within the preselected band. At the end of the inflation period, the pump 22 is turned off and the valve 32 is opened to the atmosphere allowing air to flow out of the bladder 28 allowing the spine to relax to its "neutral" condition.

Figure 5:
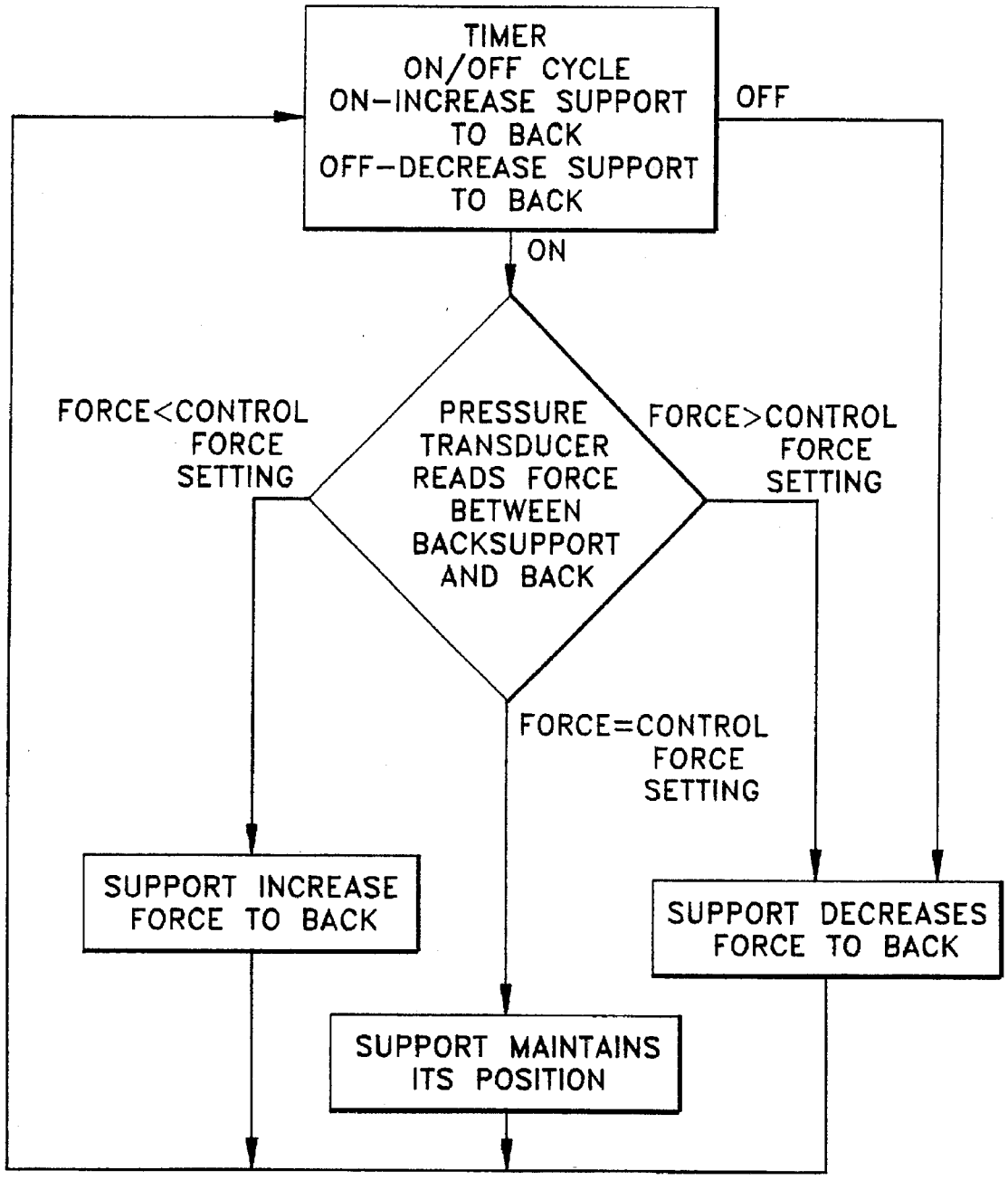
FIG. 5 is a logic diagram for the force feedback.
Figure 6:
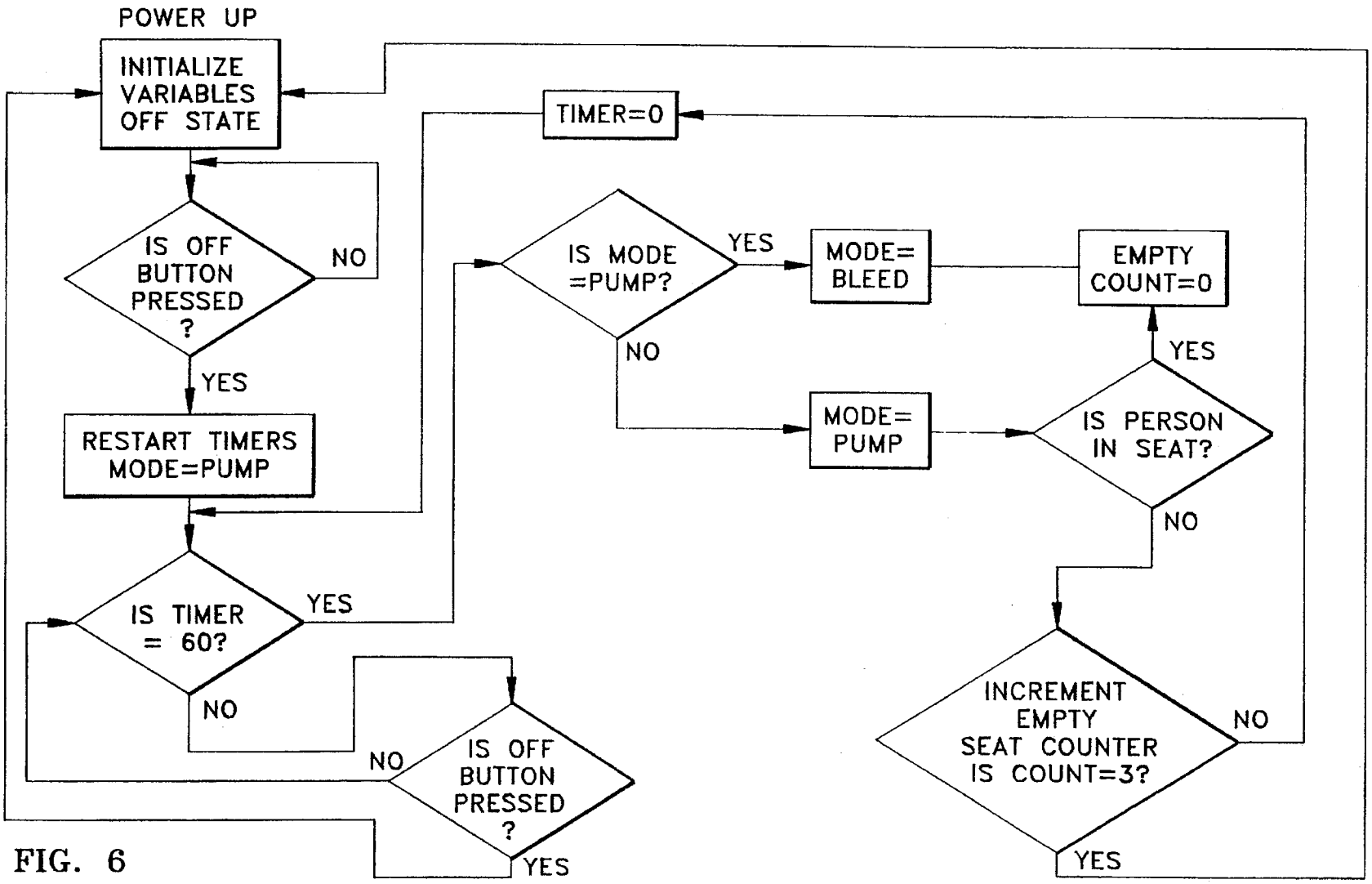
FIGS. 6 and 7 are diagrams of the main program loop and the interrupt process loop.
Figure 7A:
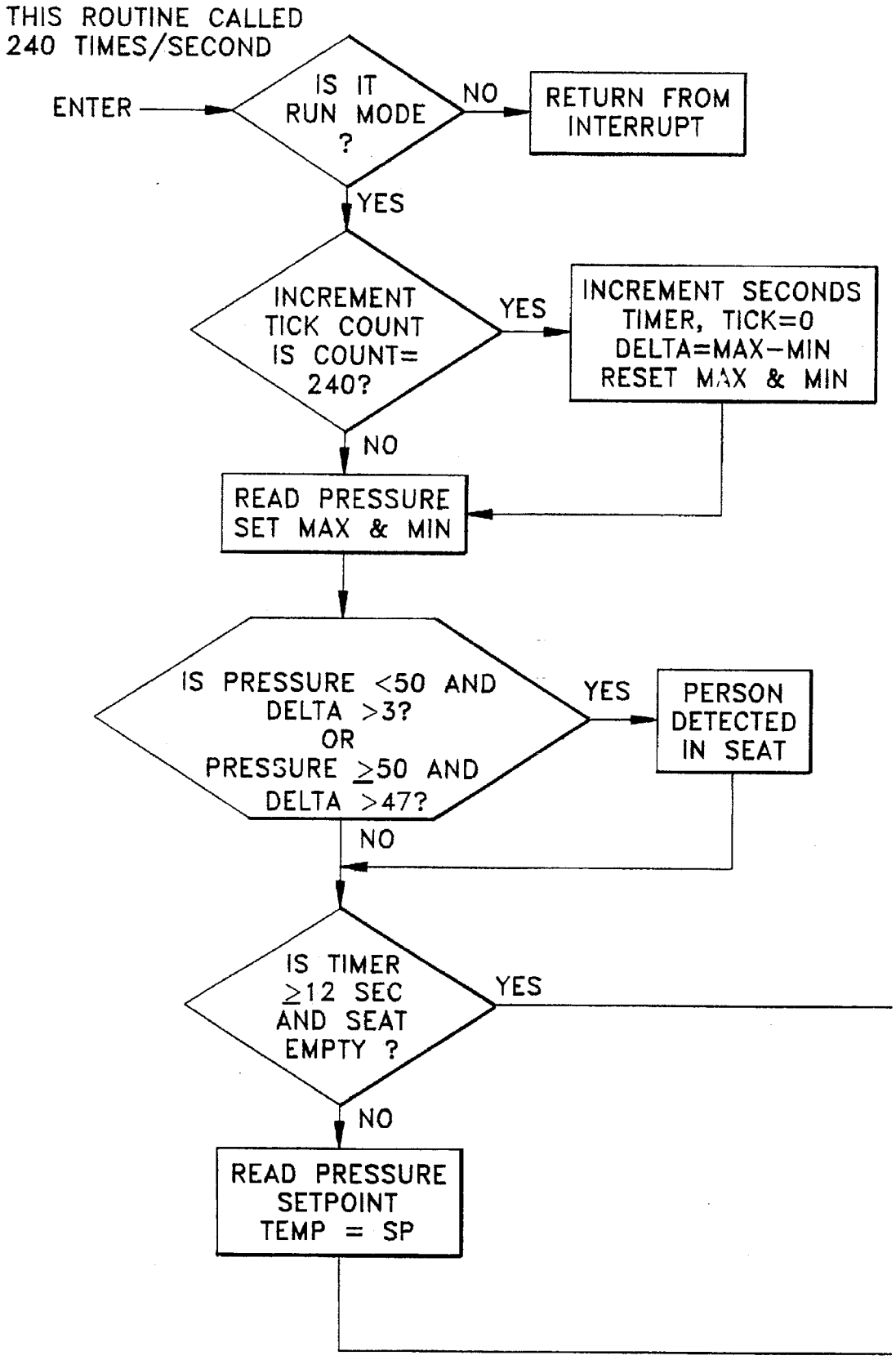
Figure 7B:
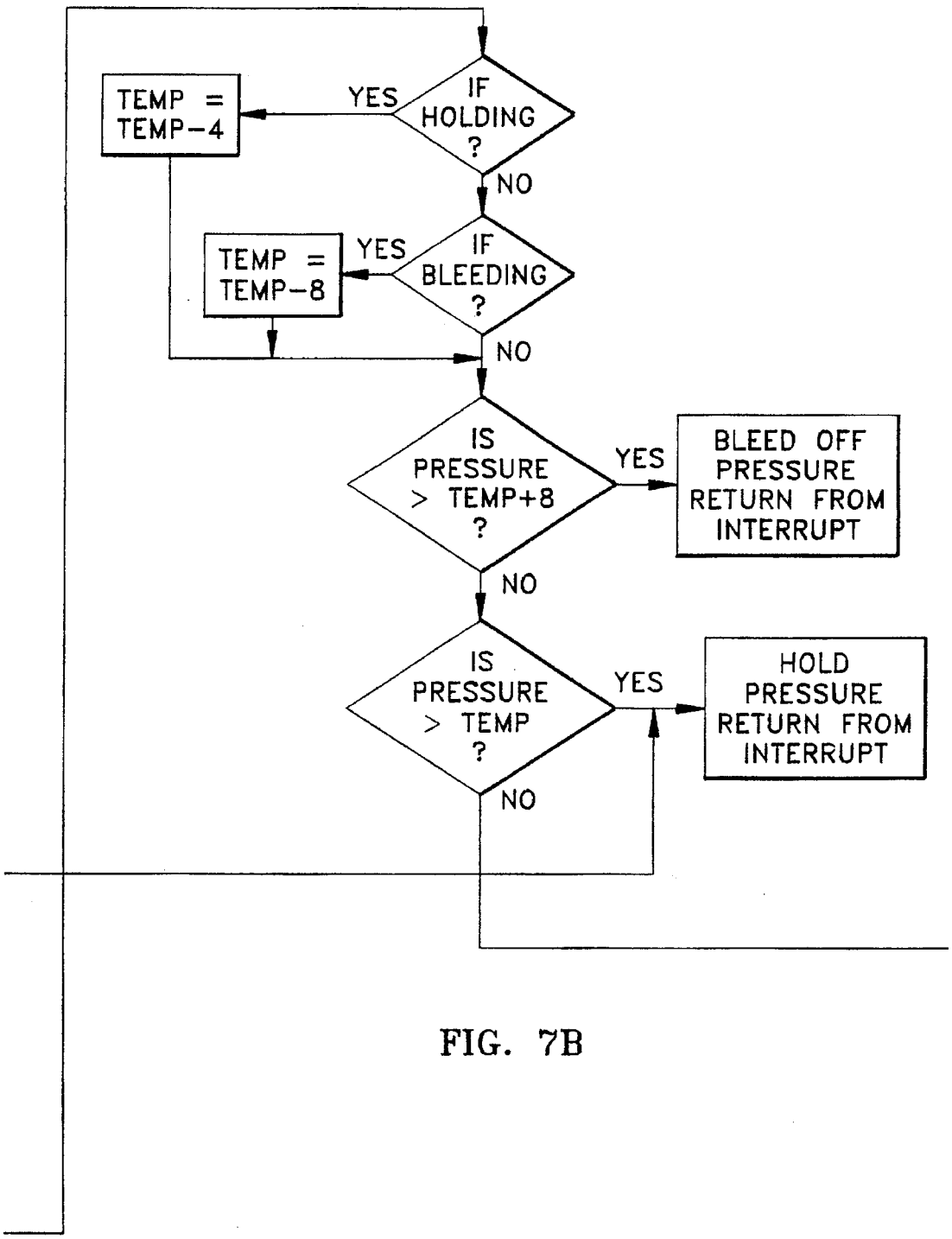
Figure 7C:
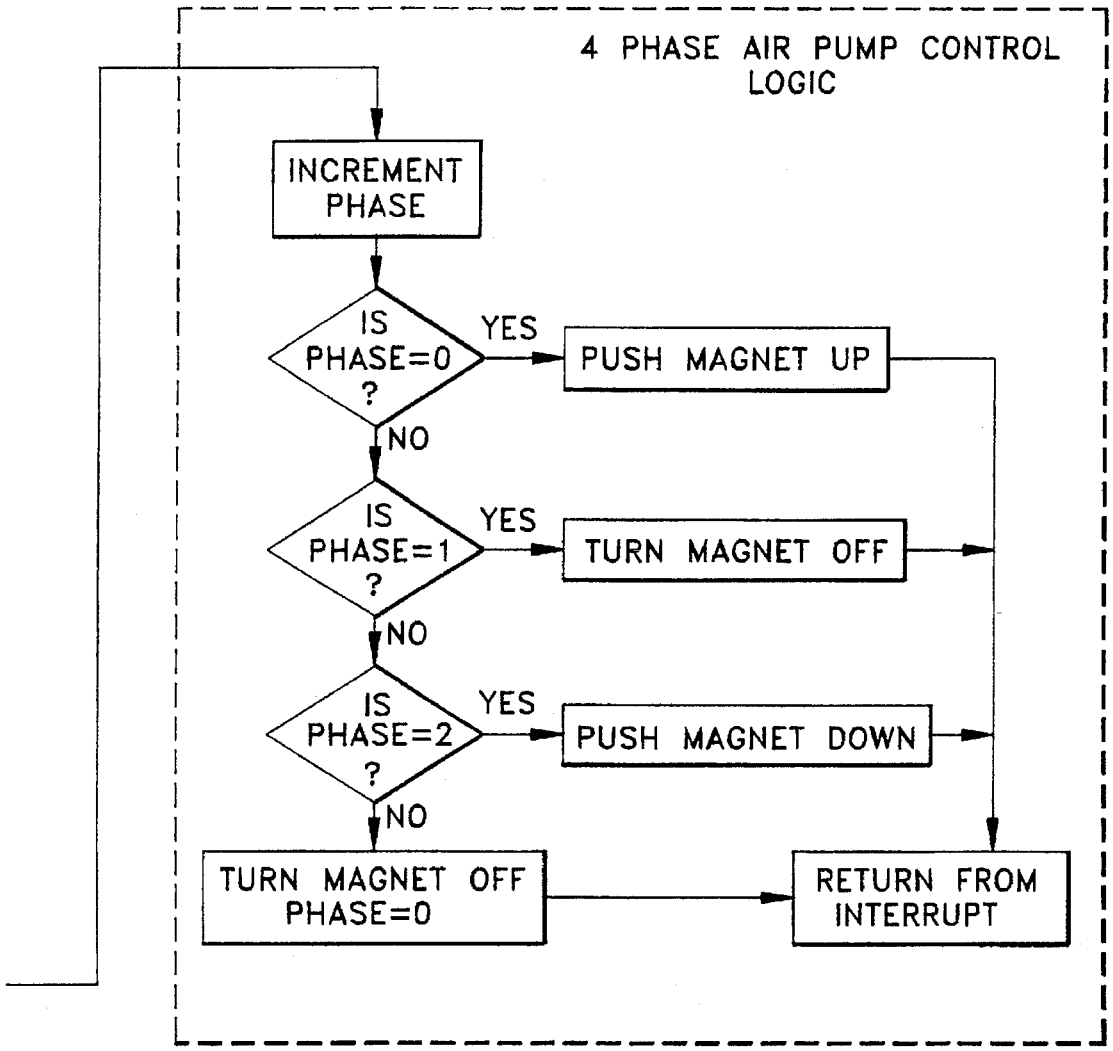

FIG. 5 is a block diagram illustrating the logic described above with respect to FIG. 4. The logic illustrated in FIG. 5 is implemented by a main program loop shown in FIG. 6 and an interrupt process loop shown in FIG. 7.

The components of a preferred embodiment of the Back-Cycler™ will now be described. When the ON button 42 is activated by the user the inflate cycle will begin. An optional sound transducer (not shown) will generate beeps at a frequency of approximately 600 Hz with a duration of 0.13 seconds and with an interval between beeps of 0.083 seconds. If the ON button 42 is depressed while the unit is already on, the timer 40 will reset a cycle counter to the beginning of the inflate cycle. Depressing the OFF button 44 will turn off the unit and this may be signalled by a single beep having a duration of 0.13 seconds to alert the user that the unit has been turned off. The preselected desired pressure in the bladder 28 is adjusted by the pressure control 46 which is an adjustable linear potentiometer in this embodiment. The potentiometer in the pressure control 46 can be adjusted between 1 and 5, for a total resolution of 130 discrete points over the full scale. One on the scale represents 10 millimeters of mercury and 5 represents 140 millimeters of mercury on this linear scale. The pressure control potentiometer 46 may be adjusted while the unit is operating. In this case, if the potentiometer is adjusted in the negative direction by any amount, the valve 32 will automatically open to decrease pressure thereby to decrease force on the back. Conversely, if the potentiometer is adjusted in the positive direction by any amount, the pump 22 will automatically increase pressure in the bladder 28, regardless of the cycle phase at which the unit is then currently operating. The light emitting diode (LED) 48 is turned on when the unit itself is turned on. Once on, the LED indicator 48 remains on until the unit is turned off or is automatically turned off. The time cycle can be adjusted by the timer 40 between 10 seconds and an infinite period. When the timer 40 is set to the infinite inflation time period the force applying apparatus acts as a static support which actively controls the amount of force to the back. In this state, force will be controlled continuously as long as the device is turned on. The time cycle is defined as a complete inflate and deflate cycle and with the infinite setting the unit can be used as a static lumbar support.

The processor board 24 is powered by a 12 volt DC source and while the unit is turned off the processor is continuously running in an idle mode. Maximum current draw in the idle mode is less than or equal to approximately 15 milliamps. At this level of draw, a typical car battery would last 1500 hours. The processor board 24 performs on-board diagnostic testing to assure appropriate performance. In a test mode, the following components are checked: processor, ram check, valve check, pump check, speaker check, zero calibration lookup table setup, 100 millimeter mercury calibration test, and a check to confirm that the full range of 0 to 140 millimeters of mercury can be read. The unit also includes voltage protection. In particular, a voltage above 18 volts will be clamped and will cause a fuse (not shown) to blow. If voltage should drop below 9.8 volts, the processor board 24 turns the pump 22 off to provide field effect transistor (FET) protection (not shown). The valve 32 and pressure transducer 34 will remain operative under these conditions. If voltage drops below 4.6 volts on a 5 volt line to the processor board 24, then the processor is reset and held until the voltage goes above 4.6 volts. Once the voltage is greater than 4.6 volts, a delay of 0.2 seconds is observed before restarting the processor. Radio frequency (RF) noise suppression is provided on the FET during 60 Hz modulation of the pump 22. A capacitor (not shown) is provided to act as a 60 Hz noise suppression filter. An automatic shut off may be provided if a person is not sitting against the bladder 28 for a selectable period of time such as for 12 seconds.

With reference now to FIG. 8 a mechanical continuous passive motion device 60 includes a motor 62 which drives a cam 64. The cam 64 moves a flexible panel 66 in and out to apply movement to the lumbar region of the spine. A load cell 68 measures the force between the flexible panel 66 and the back of a person (not shown). The cam 64 is driven by a belt 70 in contact with the motor 62.

Yet another mechanical embodiment of the invention is shown in FIG. 9. The apparatus 90 includes a motor 92 which drives a belt 94. The belt 94 turns a pinion 96 which engages a rack 98. By this means, a movable surface 100 can be moved in and out to engage the lumbar region of the spine of a user (not shown). A load cell 102 responds to force on the surface 100.

The mechanical devices illustrated in FIGS. 8 and 9 operate in substantially the same way as the pneumatic embodiment described above. As before, force increases for a period followed by a period of decreasing force so as to move the lumbar spine through substantial ranges of lordosis.

Figure 11:
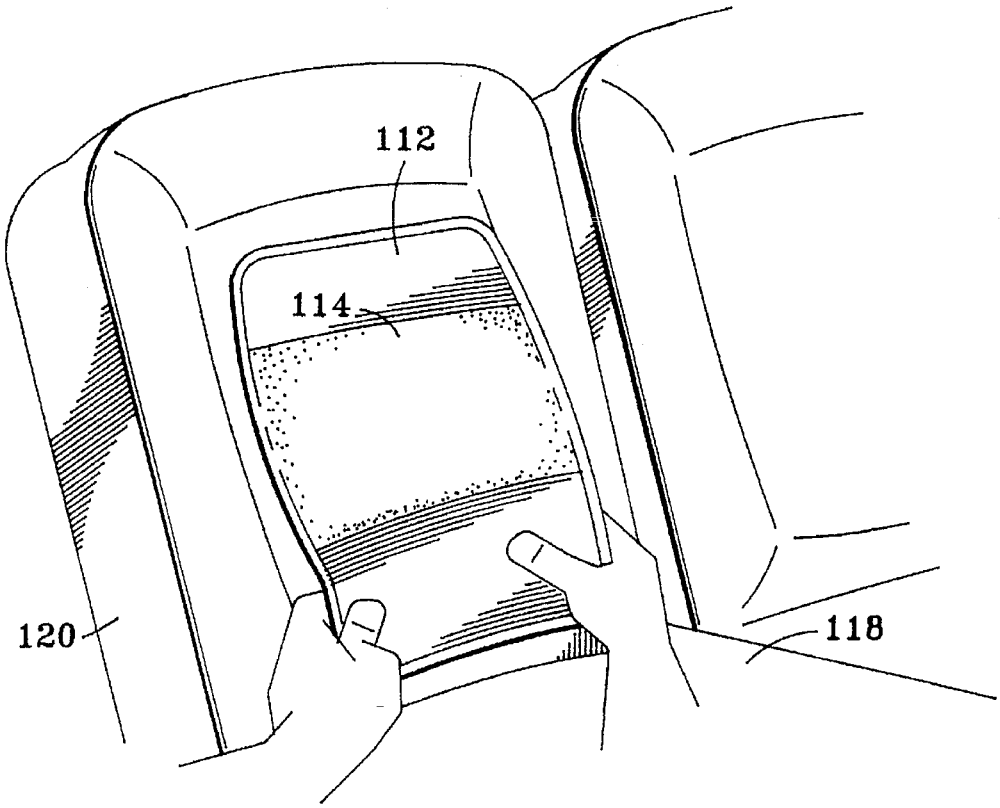
Figure 12:
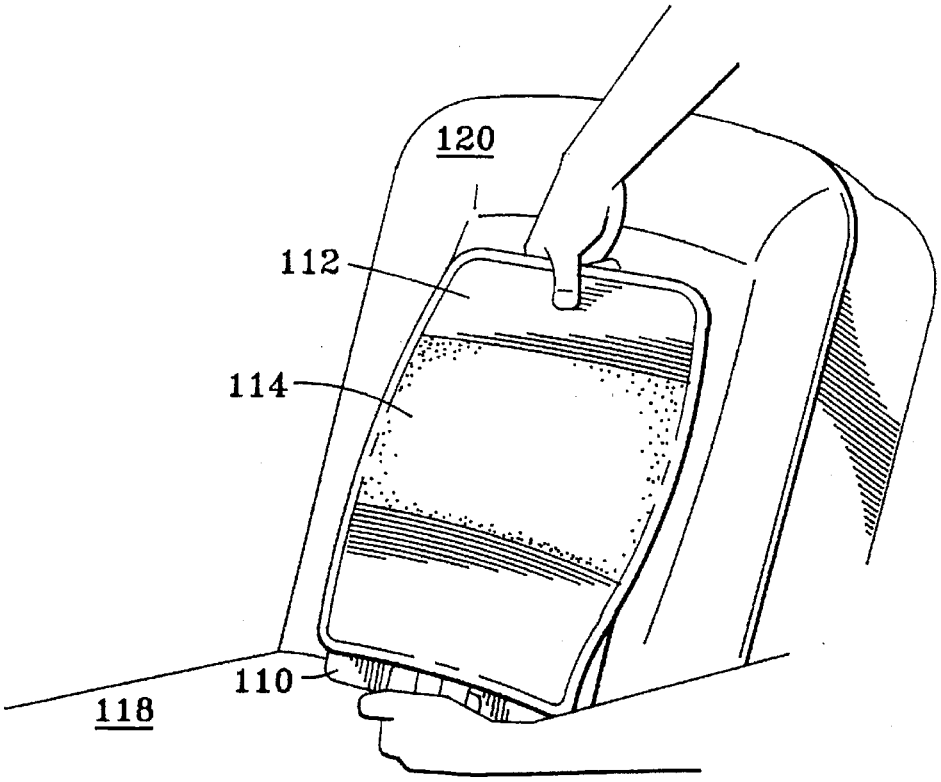

With respect now to FIGS. 10, 11 and 12, an embodiment is described which allows the location of the force applying member to be adjusted to accommodate different individuals, or the particular preference of a given individual. In these figures, a bracket 110 is adapted to receive a sleeve 112 which bears, in this embodiment, an inflatable bladder unit 114. The bracket 110 includes an extension portion 116 which is wedged between a seat cushion 118 and a seat back 120 of a seat which may be found in, for example, an automobile. The upright portion of the bracket 110 is curved rearwardly so that it engages a seat back 120 when the extending portion 116 is properly wedged between a seat cushion 118 and the seat back 120. The bracket 110 and sleeve 112 include cooperating adhering structures (not shown) such as hook and loop structures commonly known as Velcro® so as to fix the location of the sleeve 112 with respect to the bracket 110 in the vertical direction as shown in these figures. With reference to FIG. 12, the location of the sleeve 112 may be adjusted by inserting the fingers between the bracket 110 and the sleeve 112 at its lower portion to release the hook and loop material after which the sleeve 112 is moved to a different vertical location whereupon the hook and loop structure is engaged yet again. In this way, the location of the force applying section 114 may be adjusted as desired by a user. The bracket is fully removable from the sleeve 112 so that the sleeve 112 may be placed on a substantially horizontal surface such as a bed or floor for use in a supine position as described below in conjunction with FIG. 17.

Figure 13:
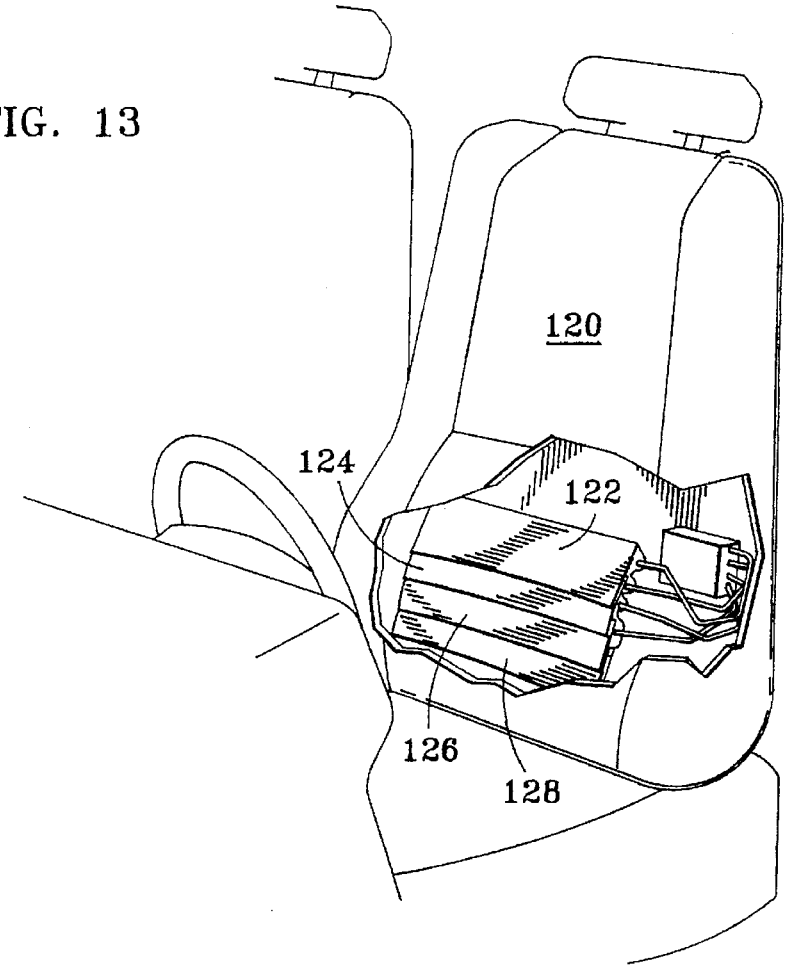
FIG. 13 is a perspective view of an embodiment of the invention including multiple bladders.
Figure 14:
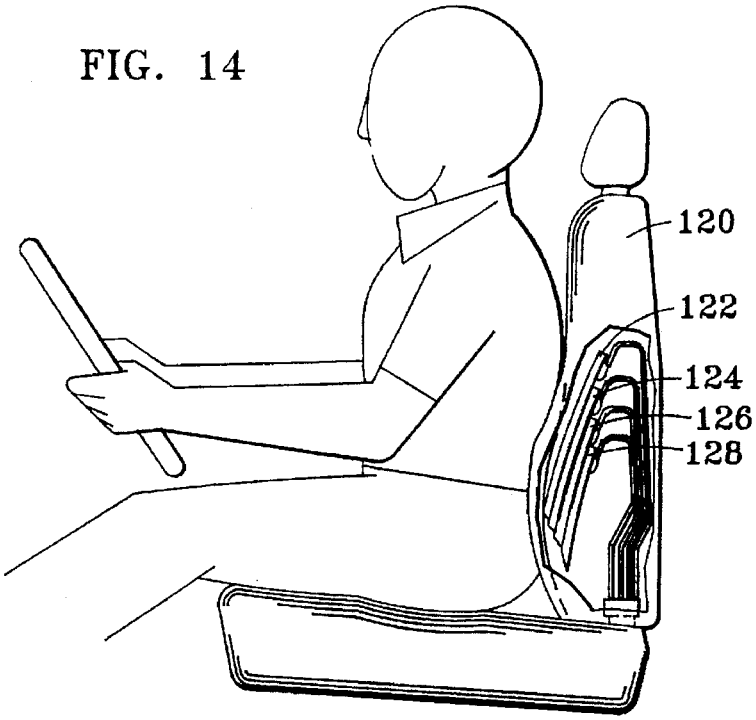
FIG. 14 is a cross-sectional view of the embodiment of FIG. 13.

Yet another embodiment of the invention which provides a selectable location for the force applying member is shown in FIGS. 13 and 14. This embodiment is particularly designed to be built into a seat such as the backrest portion 120 of an automobile. This embodiment includes a plurality of separate, spaced apart bladders 122, 124, 126, and 128. The user can select which one of the bladders to activate so as to adjust the height of the force applying surface as desired. The operation of each of the spaced apart bladders is the same as the single bladder embodiment described in conjunction with the earlier figures in this specification.

Figure 15:
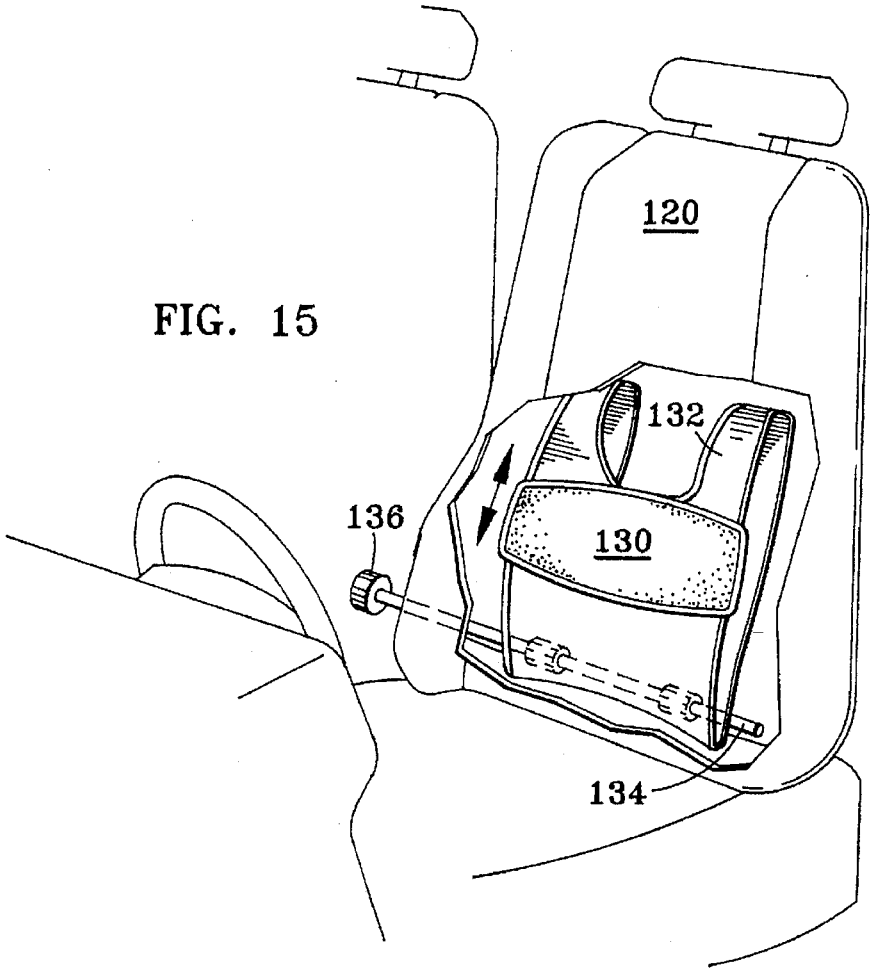
FIG. 15 is a perspective view of an embodiment of the invention permitting mechanical adjustment of the location of the inflatable bladder.
Figure 16:
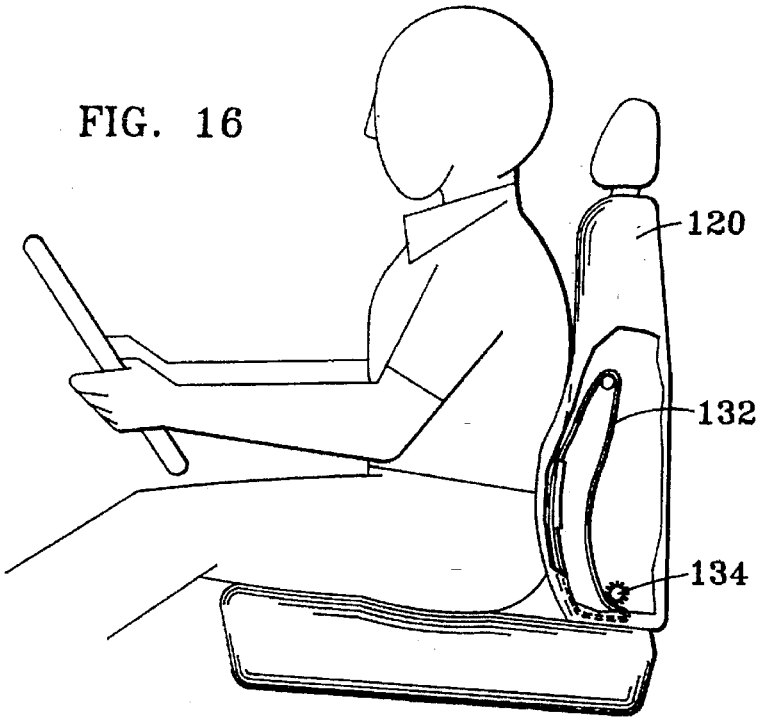
FIG. 16 is cross-sectional view of the embodiment of FIG. 15.

Yet another embodiment of the invention is shown in FIGS. 15 and 16. This design is also particularly suited to a built in application within the seat back 120 of a vehicle seat or other form of chair. A bladder 130 is fixed to a flexible material 132 which engages a rotatable shaft 134. The shaft 134 may be turned manually using a knob 136. As the knob 136 is rotated, the location of the bladder 130 moves up and down as shown by the arrows in FIG. 15 thereby to adjust the location of the bladder with respect to a user.

Figure 17:
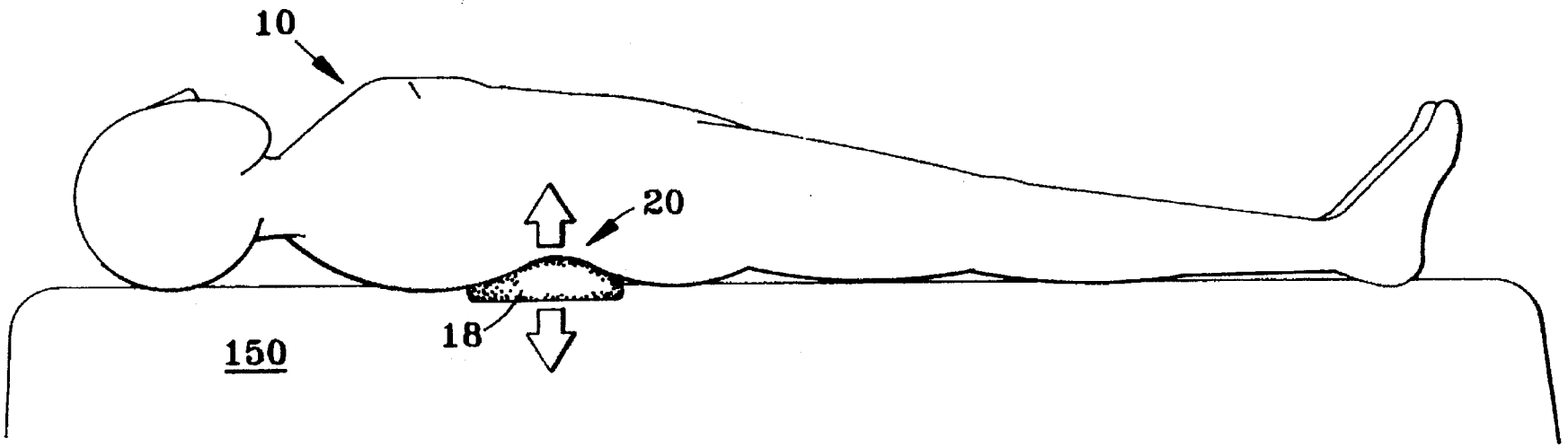
FIG. 17 is a cross-sectional view of an embodiment for supine use.

FIG. 17 illustrates the use of the present invention when the user is in a supine position. As shown in the figure, a person 10 is lying on his back on a substantially horizontal structure such as a bed 150. The force applying apparatus 118 applies force in the lumbar region 20 of the individual 10. The force applying apparatus 118 operates as described in conjunction with the other figures in this specification. As with the other embodiments, the force applying apparatus 118 moves the spine in the lumbar region 20 through a substantial range of lordotic movement while the person 10 is lying down.

It is recognized that modifications and variations of the present invention will be apparent to those skilled in the art and it is intended that all such modifications and variations be included within the scope of the claims.

What is claimed is:

1. Apparatus for cycling the lower back of a person through a substantial range of lordosis comprising:

a substantially static structure adjacent to the back of a person;

a force applying apparatus disposed between the static structure and the back of a person, the force applying apparatus including a back engaging surface cyclically moveable to increase and decrease the distance between the static structure and the back engaging surface thereby to cycle the lower back through the range of lordosis;

a transducer monitoring forces below, equal to and above a predetermined force level between the back engaging surface and the lower back and having an output responsive to said monitored forces between the back engaging surface and the lower back; and a logic system responsive to the output of the transducer for directly controlling the force applying apparatus so as to automatically and continuously control the force applied to the back.

2. The apparatus of claim 1 further including programmable circuitry for controlling the force to be a preselected function of time.

3. The apparatus of claim 1 further including timing circuitry to provide a force increasing period to increase the force applied to the back to a preselected maximum value, and a force decreasing period to decrease the force on the back.

4. The apparatus of claim 3 further including a substantially constant force period between the force increasing period and the force decreasing period.

5. The apparatus of claim 1 further adapted to provide a force increasing period to increase the force applied to the back to a preselected maximum value and to maintain the force value during operation of the apparatus.

6. The apparatus of claim 1 wherein the force applying apparatus comprises an inflatable and deflatable bladder.

7. The apparatus of claim 6 wherein the transducer responds to pressure within the bladder.

8. The apparatus of claim 7 wherein the transducer comprises a silicon wafer adapted to provide a voltage signal proportional to pressure.

9. The apparatus of claim 6 further including a pump for supplying a fluid for inflating the bladder and a valve communicating with the bladder for deflating the bladder.

10. The apparatus of claim 6 including a fluid pump for supplying fluid to the bladder.

11. The apparatus of claim 6 further including an electrically operated valve for deflating the bladder.

12. The apparatus of claim 1 wherein the location of the back engaging surface is adjustable in height.

13. The apparatus of claim 1 wherein the force applying apparatus comprises a rack and pinion arrangement for cyclically increasing and decreasing the force.

14. The apparatus of claim 1 wherein the force applying apparatus comprises a mechanical cam arrangement.

15. The apparatus of claim 13 or claim 14 wherein the transducer is a load cell.

16. Apparatus for cycling the lower back of a person through a substantial range of lordosis comprising:

a substantially static structure adjacent to the back of a person;

a force applying apparatus disposed between the static structure and the back of the person, the force applying apparatus including at least one back engaging surface cyclically movable to increase and decrease force on the lower back thereby to cycle the lower back through the range of lordosis;

a transducer monitoring forces below, equal to and above a predetermined force level on the back and having an output responsive to said monitored forces on the back; and a logic system responsive to the output of the transducer for directly controlling the force applying apparatus so as to automatically and continuously control the force applied to the back.

17. The apparatus of claim 16 further including apparatus for adjusting the location of the back engaging surface with respect to the back of the person.

18. The apparatus of claim 17 wherein the adjusting apparatus comprises:

a bracket including means for securing the bracket to a seat structure; and a sleeve including the force applying apparatus adapted to slide over the bracket, the sleeve and bracket including at least two spaced apart, cooperating adhering structures whereby the position of the sleeve with respect to the bracket is adjustable.

19. The apparatus of claim 18 wherein the bracket is removable from the sleeve allowing the force applying apparatus to be used on a substantially horizontal surface.

20. The apparatus of claim 18 wherein the adhering structures comprise hook and loop elements.

21. The apparatus of claim 17 wherein the adjusting apparatus comprises:

a flexible material surrounding and engaging a rotatable shaft, the flexible material bearing the force applying apparatus; and a gripping structure affixed to the shaft for rotating the shaft thereby to adjust the location of the force applying apparatus.

* * * * *